US008433214B2

(12) United States Patent
Oak

(10) Patent No.: US 8,433,214 B2
(45) Date of Patent: Apr. 30, 2013

(54) IMAGE FORMING SYSTEM, USER AUTHENTICATING METHOD THEREOF, AND CONTROL METHOD THEREOF

(75) Inventor: Seung-soo Oak, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 539 days.

(21) Appl. No.: 12/632,936

(22) Filed: Dec. 8, 2009

(65) Prior Publication Data

US 2010/0142989 A1 Jun. 10, 2010

(30) Foreign Application Priority Data

Dec. 10, 2008 (KR) ..... 10-2008-0125412

(51) Int. Cl.
*G03G 15/00* (2006.01)

(52) U.S. Cl.
USPC ..... 399/80; 399/76

(58) Field of Classification Search ..... 399/76, 399/80
See application file for complete search history.

(56) References Cited

U.S. PATENT DOCUMENTS

2006/0104656 A1* 5/2006 Tomita et al. ..... 399/80
2006/0245621 A1* 11/2006 Uno ..... 382/115
2008/0181648 A1* 7/2008 Makishima et al. ..... 399/75
2009/0055903 A1* 2/2009 Inose ..... 726/4

FOREIGN PATENT DOCUMENTS

JP 2007026341 A * 2/2007

OTHER PUBLICATIONS

JP 2007026341 A English Abstract to Suzuki, Feb. 2007.*

* cited by examiner

*Primary Examiner* — Ryan Walsh
(74) *Attorney, Agent, or Firm* — Stanzione & Kim, LLP

(57) ABSTRACT

An image forming system, and a user authenticating method and a control method thereof, the image forming system including a plurality of image forming apparatuses communicably connected and performing a first authentication of a user in a first image forming apparatus of the plurality of image forming apparatuses; requesting a second authentication of the user from at least one second image forming apparatus of the plurality of image forming apparatuses in response to the first authentication failing in the first image forming apparatus; and finally authenticating the user based on a result of the second authentication.

26 Claims, 10 Drawing Sheets

FIG. 3

| USER ID | PASSWORD | OTHER APPARATUS USING AUTHORITY | SCANNING | COPYING | PRINTING | FACSIMILE | COLOR/MONO |
|---|---|---|---|---|---|---|---|
| Jack | XXXX | Y | ○ | ○ | ○ | ○ | C/M |
| David | XXXX | N | ○ | × | ○ | ○ | M |
| Steve | XXXX | N | × | × | ○ | × | M |
| Jane | XXXX | Y | × | ○ | ○ | × | M |
| ・・・ | ・・・ | ・・・ | ・・・ | ・・・ | ・・・ | ・・・ | ・・・ |

FIG. 4

| USER ID | PASSWORD | OTHER APPARATUS USING AUTHORITY | SCANNING | COPYING | PRINTING | FACSIMILE | COLOR/MONO |
|---|---|---|---|---|---|---|---|
| Tom | aaa | Y | ○ | ○ | ○ | ○ | C/M |
| James | aaa | Y | ○ | × | ○ | ○ | M |
| Clark | aaa | N | × | × | ○ | × | M |
| David | XXXX | Y | × | ○ | ○ | × | M |
| ⋮ | ⋮ | ⋮ | ⋮ | ⋮ | ⋮ | ⋮ | ⋮ |

FIG. 5

| USER ID | POSITION INFORMATION OF IMAGE FORMING APPARATUS IN WHICH USER AUTHENTICATION INFORMATION IS STORED |
|---|---|
| Jack | 123 . 13 . 1 . 5 |
| Tom | 124 . 13 . 1 . 5 |
| Clark | 124 . 13 . 1 . 5 |
| David | 123 . 13 . 1 . 5<br>124 . 13 . 1 . 5 |
| ⋮ | ⋮ |

IMAGE FORMING SYSTEM, USER AUTHENTICATING METHOD THEREOF, AND CONTROL METHOD THEREOF

CROSS-REFERENCE TO RELATED APPLICATIONS

This application claims priority under 35 U.S.C. §119(a) from Korean Patent Application No. 10-2008-0125412, filed on Dec. 10, 2008, in the Korean Intellectual Property Office, the disclosure of which is incorporated herein by reference in its entirety.

BACKGROUND

1. Field of the Invention

An apparatus and methods consistent with the present general inventive concept relate to an image forming system, a user authenticating method thereof and a control method thereof, and more particularly, to an image forming system, a user authenticating method thereof and a control method thereof to authenticate a user without a separate authentication server.

2. Description of the Related Art

An image forming apparatus performs such operations as forming an image on a printing medium, scanning an image formed on a document, etc. Examples of an image forming apparatus may include a scanner, a printer, an electronic copier, a facsimile, a multifunction device performing all of the functions or a part thereof, etc.

An image forming system includes a plurality of image forming apparatuses connected to communicate with one another.

Also, the image forming system further includes a separate authentication server to authenticate a user who wants to use one of the image forming apparatuses to perform a job such as printing, copying, etc. However, the cost of the image forming system increases by providing a separate authentication server. Also, since most information needed to authenticate a user is concentratively stored in the authentication server, a security risk is increased.

SUMMARY

Example embodiments of the present general inventive concept provide an image forming system, a user authenticating method thereof and a control method thereof to authenticate a user without a separate authentication server.

Another feature of the present general inventive concept is to provide an image forming system, a user authenticating method thereof and a control method thereof to improve a user's convenience.

Still another feature of the present general inventive concept is to provide an image forming system, a user authenticating method thereof and a control method thereof to enhance security.

Yet another feature of the present general inventive concept is to provide an image forming system, a user authenticating method thereof and a control method thereof to reduce a user authenticating time.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a user authenticating method of an image forming system which includes a plurality of image forming apparatuses communicably connected, the method including: performing a first authentication of a user in a first image forming apparatus of the plurality of image forming apparatuses; requesting a second authentication of the user from at least one second image forming apparatus of the plurality of image forming apparatuses in response to the first authentication failing in the first image forming apparatus; and finally authenticating the user based on a result of the second authentication.

The method may further include determining that the first authentication failed in response first authentication information stored in the first image forming apparatus not corresponding with identification information of the user.

If stored position information indicates the second image forming apparatus in which authentication information of the user is stored, the requesting the second authentication may include requesting the second authentication of the user from only the second image forming apparatus identified in the position information.

The requesting the second authentication of the user may include performing the second authentication based on identification information of the user and a second user authentication information stored in the second image forming apparatus.

The second user authentication information may include other apparatus using authority information assigned to users regarding whether the corresponding user is authorized to use other image forming apparatuses besides the second image forming apparatus in which the second user authentication information is stored.

The method may further include transmitting an authentication success to the first image forming apparatus as a result of the second authentication in response to the user having the other apparatus using authority.

The method may further include transmitting an authentication failure to the first image forming apparatus as the result of the second authentication in response to the user not having the other apparatus using authority.

The method may further include transmitting an authentication success to the first image forming apparatus as a result of the second authentication in response to the user having the other apparatus using authority.

The method may further include not transmitting the result of the second authentication to the first image forming apparatus in response to the user not having the other apparatus using authority.

The finally authenticating the user may include determining that the authentication of the user finally fails in response to the result of the second authentication received from the second image forming apparatus being an authentication failure, or in response to the result of the second authentication not being received from the second image forming apparatus during a predetermined time.

The method may further include storing position information of the second image forming apparatus storing the authentication information of the user based on the result of the second authentication transmitted from the second image forming apparatus.

The foregoing and/or other features and utilities of the present general inventive concept may also be achieved by providing a control method of an image forming system which includes a plurality of image forming apparatuses communicably connected, the method including: inputting identification information of a user and position information of an image forming apparatus in which an authentication information of the user is stored; requesting an authentication of the user from the image forming apparatus corresponding to the position information; and selectively performing a predetermined job which the user requests based on an authentication result.

The inputting the identification information of the user and the position information of the image forming apparatus may include reading information recorded in an identification (ID) card of the user.

The method may further include performing a first authentication of the user by an image forming apparatus into which the identification information and the position information are input in response to the image forming apparatus into which the identification information and the position information are input being included in the position information.

The requesting the authentication of the user from the image forming apparatus corresponding to the position information may be performed in response to failure of the first authentication.

The foregoing and/or other features and utilities of the present general inventive concept may also be achieved by providing a control method of an image forming system which includes a plurality of image forming apparatuses communicably connected, the method including: requesting a job from a first image forming apparatus of the plurality of image forming apparatuses; performing a first authentication of a user requesting the job based on first user authentication information in the first image forming apparatus; requesting a second authentication of the user from at least one second image forming apparatus of the plurality of image forming apparatuses in response to a failure of the first authentication in the first image forming apparatus; and selectively performing the job based on a result of the second authentication.

The predetermined job may include scanning, copying, faxing, a color printing, a mono printing, or any combination thereof.

The first user authentication information may include using authority information of the job, other apparatus using authority information regarding whether the user is authorized to use the second image forming apparatus, or a combination thereof, respective to any users stored in the first user authentication information.

The method may further include storing position information of the second image forming apparatus storing an authentication information of the user based on the second authentication result.

The method may further include informing the user of an authentication failure in response to all second authentication results received from at least one of other image forming apparatuses indicating authentication failure.

The foregoing and/or other features and utilities of the present general inventive concept may also be achieved by providing an image forming system, including: a first image forming apparatus which includes a first communicating unit and a first storing unit to store first user authentication information; and a second image forming apparatus which includes a second communicating unit to communicate with the first communicating unit and a second storing unit to store second user authentication information, wherein the first image forming apparatus performs a first authentication using user identification information and the first user authentication information, and requests a second authentication from the second image forming apparatus in response to failure of the first authentication, and the second image forming apparatus performs the second authentication using the user identification information and the second user authentication information, and transmits a result of the second authentication to the first image forming apparatus.

The first image forming apparatus may determine that the first authentication fails in response to there being no information stored in the first user authentication information regarding a user requesting authentication.

The first user authentication information and/or the second user authentication information may include other apparatus using authority information indicating whether a user is authorized to use another apparatus.

The second image forming apparatus may transmit an authentication success to the first image forming apparatus as the second authentication result in response to the user having other apparatus using authority.

The second image forming apparatus may transmit an authentication failure to the first image forming apparatus as the second authentication result in response to the user not having other apparatus using authority.

The first image forming apparatus may further include an input unit to receive the user identification information.

The first image forming apparatus may perform a job of scanning, copying, printing, faxing, or any combination thereof in response to receiving a successful second authentication result from the second image forming apparatus.

The first image forming apparatus may inform the user of the authentication failure in response to failure of the second authentication.

If position information stored in the first storing unit indicates the second image forming apparatus storing the authentication information of the user, the first image forming apparatus may request the second authentication of the user from only the second image forming apparatus corresponding to the position information.

The first image forming apparatus may store position information of the second image forming apparatus storing the authentication information of the user in the first storing unit based on the second authentication result.

The foregoing and/or other features and utilities of the present general inventive concept may also be achieved by providing an image forming system including a terminal connectable to a plurality of image forming apparatuses, and having a communicating unit to perform a first authentication on a first one of the image forming apparatuses using user information, and to perform a second authentication on a second one of the image forming apparatuses according to failure of the first authentication, to perform a printing operation.

The first and second image forming apparatuses may have information different from each other, and the user information is compared with the information of the first image forming apparatus and then the information of the second image forming apparatus to perform the printing operation.

The foregoing and/or other features and utilities of the present general inventive concept may also be achieved by providing a method of authenticating a user at one of a plurality of connected image forming apparatuses, the method including performing a first authentication at a first image forming apparatus; and requesting a second authentication from a second image forming apparatus in response to failure of the first authentication.

The first authentication may include determining whether user identification information corresponds to first user authentication information.

The user identification information may be input through an input key at the first image forming apparatus.

The user identification information may be input through a card reader at the first image forming apparatus.

The user identification information may be input through a fingerprint reader.

The first user authentication information may include information regarding jobs that the user is authorized to request.

The second authentication may include determining whether user identification information corresponds to second user authentication information.

The second user authentication information may include information regarding jobs that the user is authorized to request.

The second user authentication information may include information regarding whether the user is authorized to use image forming apparatuses other than the second image forming apparatus.

The first image forming may store sub user authentication information including position information regarding which image forming apparatus stores user authentication information of the user.

The requesting the second authentication from the second image forming apparatus may include selecting the second image forming apparatus according to the sub user authentication information.

The first image forming apparatus may update the sub user authentication information according to authentication results received from the second image forming apparatus.

The foregoing and/or other features and utilities of the present general inventive concept may also be achieved by providing a recording medium having recorded thereon a program to cause a computer to perform a method of authenticating a user at one of a plurality of connected image forming apparatuses, the method including performing a first authentication at a first image forming apparatus; and requesting a second authentication from a second image forming apparatus in response to failure of the first authentication.

The foregoing and/or other features and utilities of the present general inventive concept may also be achieved by providing a method of authenticating a user at one of a plurality of connected image forming apparatuses, the method including transmitting a user authentication request from a first image forming apparatus to one or more of the connected image forming apparatuses in response to a failed user authentication at the first image forming apparatus.

The method may further include receiving a user authentication of the user from the one or more of the connected image forming apparatuses.

The user authentication may be transmitted due to user identification information received from the first image forming apparatus corresponding to user authentication information stored in the one or more of the connected image forming apparatuses.

The stored user authentication information may indicate the type of jobs the user may request from the first image forming apparatus.

The stored user authentication information may indicate whether the user is authorized to request jobs from other ones of the connected image forming apparatuses.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 3 illustrates an example of first user authentication information stored in a first image forming apparatus of the image forming system in FIG. 1;

FIG. 4 illustrates an example of second user authentication information stored in a second image forming apparatus of the image forming system in FIG. 1;

FIG. 5 illustrates an example of sub user authentication information stored in the first image forming apparatus of the image forming system in FIG. 1;

DETAILED DESCRIPTION OF THE EMBODIMENTS

Figure 1:
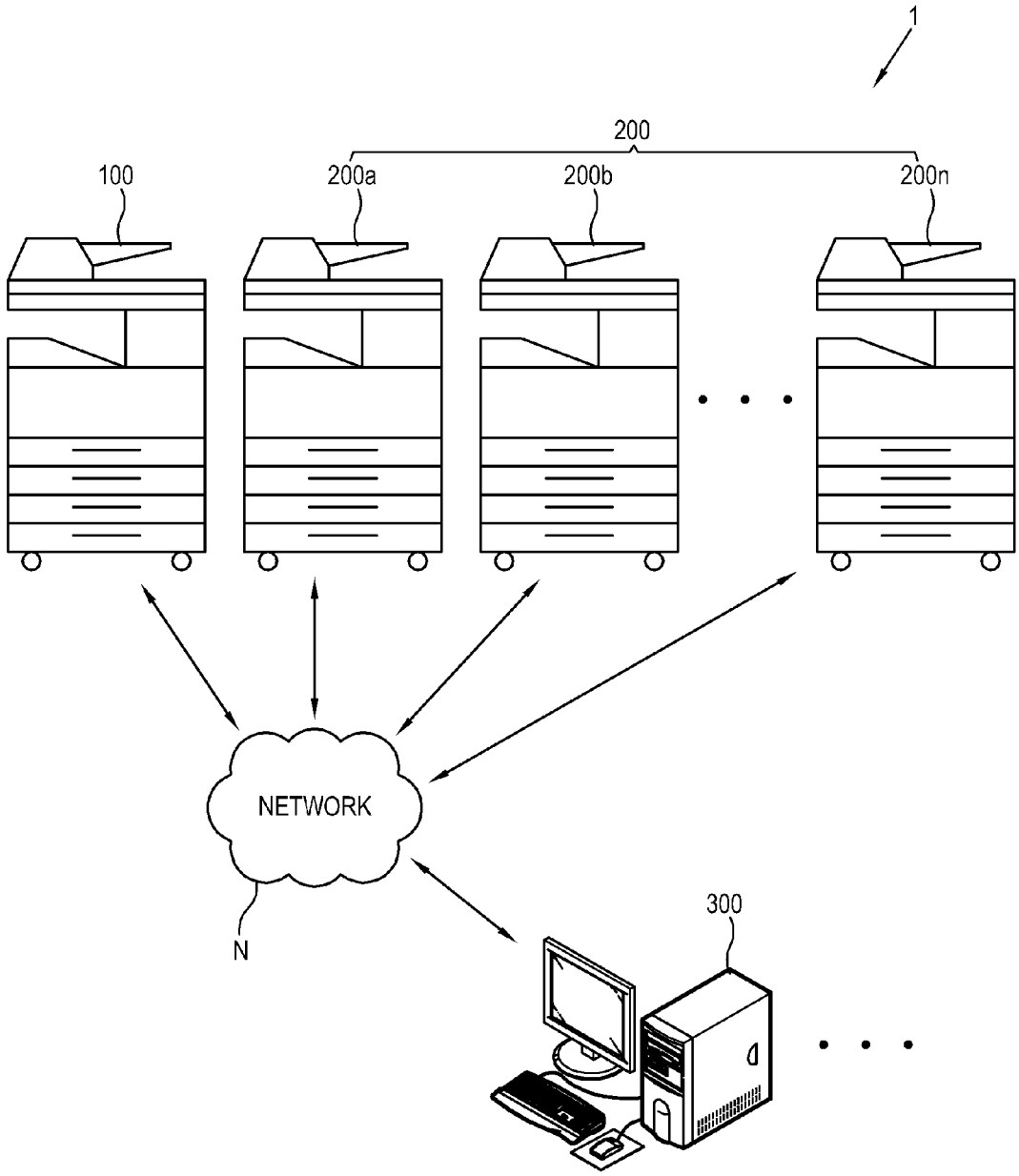
FIG. 1 is a schematic view illustrating an image forming system according to an exemplary embodiment of the present general inventive concept.

Reference will now be made in detail to various exemplary embodiments of the present general inventive concept, examples of which are illustrated in the accompanying drawings, wherein like reference numerals refer to like elements throughout. The exemplary embodiments are described below in order to explain the present general inventive concept by referring to the figures. Repetitive description with respect to like elements of different embodiments may be omitted for the convenience of clarity.

Figure 2:
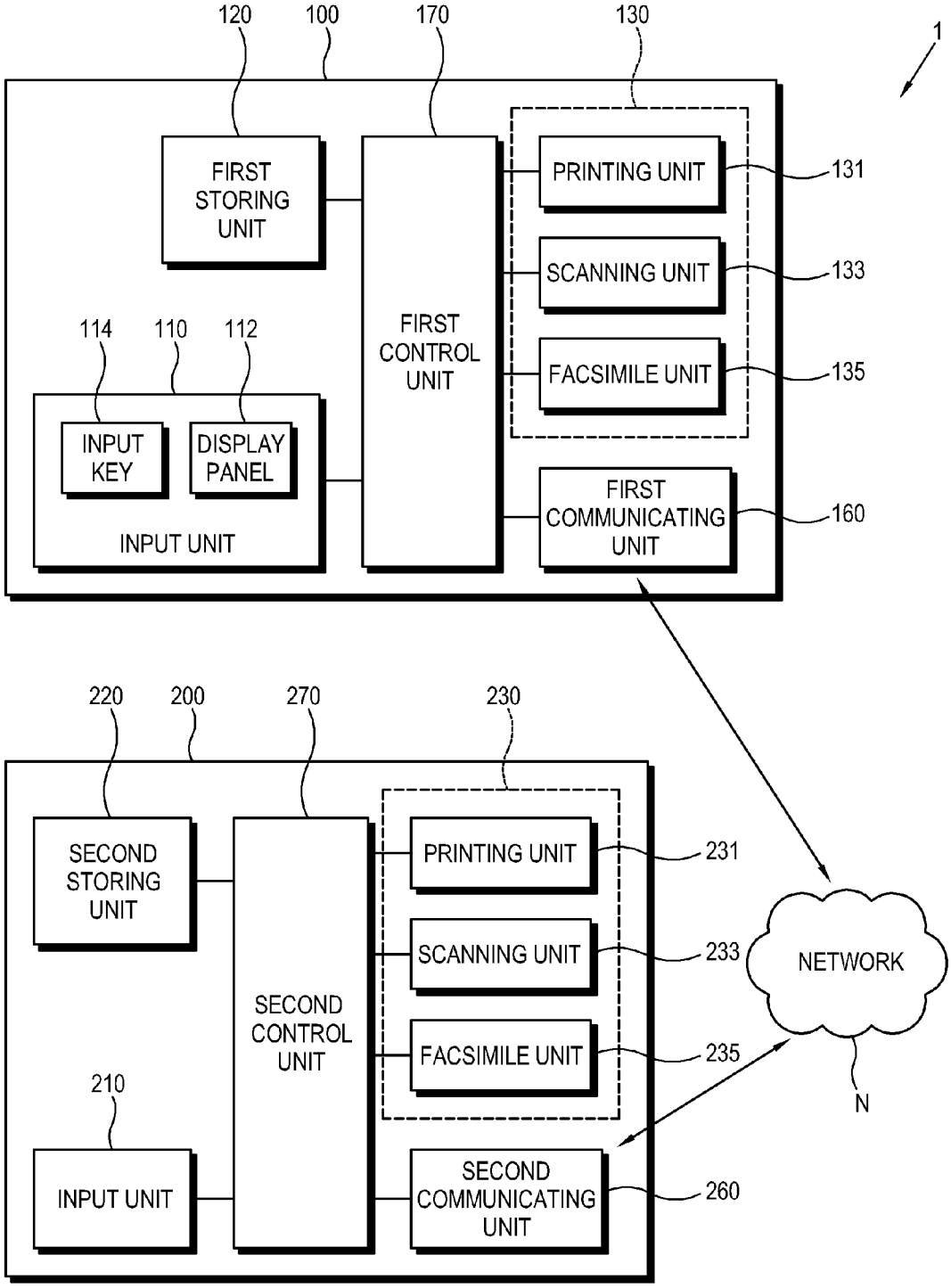
FIG. 2 is a schematic block diagram illustrating the image forming system in FIG. 1.

FIG. 1 is a schematic view illustrating an image forming system according to an exemplary embodiment of the present general inventive concept, and FIG. 2 is a schematic block diagram illustrating the image forming system in FIG. 1.

As illustrated in FIGS. 1 and 2, the image forming system 1 according to this embodiment of the present general inventive concept may include a first image forming apparatus 100 and a second image forming apparatus 200 communicating with each other through a network N.

Although referred to in the singular form, the second image forming apparatus 200 may refer to one or more image forming apparatuses in the image forming system 1 that are connected through the network N to the first image forming apparatus 100. In other words, the second image forming apparatus may actually refer to a single image forming apparatus, or may include a plurality of second image forming apparatuses 200*a*, 200*b*, . . . , 200*n* as illustrated in FIG. 1. In other words, while the following descriptions generally refer to the second image forming apparatus 200, it is understood that this may indicate any of the second image forming apparatuses 200*a*, 200*b*, . . . , 200*n*, and these respective identifiers may be used interchangeably with the identifier "200".

The image forming system 1 may further include a client 300.

The client 300 may transmit printing data to be printed to the first image forming apparatus 100 or the second image forming apparatus 200 through the network N. The transmission of the printing data through the network N may be achieved through any number of wired and/or wireless communication methods.

If the first and second image forming apparatuses 100 and 200 of the image forming system 1 are provided to perform only copying, scanning and facsimile functions, the client 300 may be omitted according to the relative requirements of the system.

The first image forming apparatus 100 may include a first communicating unit 160, a first storing unit 120 to store first user authentication information, a job performing unit 130 and a first control unit 170.

The first communicating unit 160 may include a network interface card that is connectable to the network N. Also, the first communicating unit 160 may include a blue tooth interface, an infrared ray data communication interface, etc., along with, or instead of, the network interface card. The first communicating unit 160 may include other configurations along with or in place of the above interfaces as long as the first and second image forming apparatuses 100 and 200 can communicate with each other.

The first storing unit 120 may include a hard disk, a non volatile memory (a static random access memory (SRAM), a flash memory, an electrically erasable programmable read only memory (EEPROM), etc.), or any combination thereof. The first storing unit 120 may include a memory or a storing unit of other types and/or configurations as long as the first user authentication information can be stored therein.

The first control unit 170 may use identification information of a user wanting to use the first image forming apparatus 100 and the first user authentication information stored in the first storing unit 120 to perform a first authentication with respect to the user.

If the first authentication fails, the first control unit 170 may control the first communicating unit 160 to transmit a second authentication request to the second image forming apparatus 200 connected to the network N.

The job performing unit 130 may include a printing unit 131 to print images onto a printing medium, a scanning unit 133 to scan an image formed on a document, a facsimile unit 135, etc., or any combination thereof.

The printing unit 131 may print printing data received from the client 300 connected to the network N, printing data stored in the first storing unit 120, printing data received from some other source such as a portable memory device (not shown), image data of a document scanned by the scanning unit 133, etc., on the printing medium. The printing unit 131 may employ an inkjet type printer, an electrophotographic type printer, a thermal transferring type printer, etc., or any combination thereof.

The scanning unit 133 may include a charge coupled device (CCD), a contact image sensor (CIS), etc., or any combination thereof.

FIG. 3 illustrates an example of first user authentication information stored in a first image forming apparatus of the image forming system in FIG. 1. A process of the first authentication will be described in more detail by referring to FIG. 3.

As illustrated in FIG. 3, the first user authentication information may include a user ID (name), a password, 'other apparatus using authority' information and a predetermined job performing authority.

The 'other apparatus using authority' is an authority to use other image forming apparatuses of the image forming system 1 along with the first image forming apparatus 100 in which the first user authentication information is stored. In other words, the user identified in the first user authentication information is able to use the second image forming apparatus 200 and the first image forming apparatus 100, and the first user authentication information is stored in the first image forming apparatus 100.

For example, users such as "Jack" and "Jane" (FIG. 3), who both have the 'other apparatus using authority' ('Y' in FIG. 3), are capable of using the second image forming apparatus 200 in addition to the first image forming apparatus 100.

Conversely, users such as "David" and "Steve" (FIG. 3), who have no 'other apparatus using authority' ('N' in FIG. 3), are capable of using only the first image forming apparatus 100, and are incapable of using the second image forming apparatus 200.

In the case in which the first image forming apparatus 100 is capable of performing a plurality of operations (scanning, copying, printing, facsimile, color printing/mono printing, etc.), the predetermined job performing authority information may include information regarding the authority of a user to perform each respective operation. In FIG. 3, a circle '○' indicates that the subject user has authority to perform the subject operation, and an 'X' indicates that the subject user does not have authority to perform the subject operation. Also, regarding the information illustrated in FIG. 3 referred to as COLOR/MONO, 'C/M' indicates that both color and mono printings are available, and 'M' indicates that only mono printing is available.

In the case in which the first image forming apparatus 100 performs only one such operation, the predetermined job performing authority information may be omitted. Also, if desired, the predetermined job performing authority information may be omitted even in the case in which the first image forming apparatus 100 does perform a plurality of operations (scanning, copying, printing, facsimile, etc.).

If the user wanting to use the first image forming apparatus 100 is 'Jack', and the user identification information and the first user authentication information correspond such that the user is verified as 'Jack', the first control unit 170 may determine that the first authentication is successful. Also, the first control unit 170 may control the job performing unit 130 to perform a predetermined job which the user wants to perform. For example, if 'Jack' requests copying, the first control unit 170 may control the scanning unit 133 and the printing unit 131 to scan an image of a document and to print the scanned image on a printing medium.

If the user identification information does not correspond to the first user authentication information, the first control unit 170 may determine that the first authentication fails.

If the first user authentication information includes the predetermined job performing authentication information, information regarding the type of job requested by the user may be required in the first authentication as well as the user identification information. Alternatively, the job information may not be necessary in the first authentication when the predetermined job performing authority information is not included in the first user authentication information.

For example, if 'Tom' is input as the user ID of the user identification information, since there is no authentication information about 'Tom' in the first user authentication information stored in the first storing unit 120, the first authentication can be determined to fail.

Also, for example, if the user identification information corresponds with the information stored in the first user authentication information regarding 'David', and a job which the user ('David') requests is 'copying', since there is no authority to allow the copying operation to this user according to the first user authentication information ('X' in FIG. 3), the first authentication can be determined to fail. In this example, the user identification information ('David') and the job information ('copying') are used in the first authentication.

If the first authentication fails, the first control unit 170 may control the first communicating unit 160 to transmit the user identification information to the second image forming apparatus 200 to request a second authentication. In this case, the job information may be transmitted to the second image forming apparatus 200*a* together with the user identification information.

The second image forming apparatus 200 may include a second communicating unit 260 to communicate with the first communicating unit 160, a second storing unit 220 to store second user authentication information, and a second control unit 270. Here, the plurality of second image forming apparatuses 200*a*, 200*b*, . . . , 200*n*, which may serve as the second image forming apparatus 200 in FIG. 2, may have the same configurations. However, different second user authentication information may be stored in each of the plurality of second image forming apparatuses 200*a*, 200*b*, . . . , 200*n*.

The second communicating unit 260 may be provided to correspond to the first communicating unit 160.

The second storing unit 220 may include a hard disk, a non volatile memory (an SRAM, a flash memory, an EEPROM, etc.), etc., or any combination thereof.

If the second authentication request is received from the first image forming apparatus 100 through the second communicating unit 260, the second control unit 270 may use the identification information of the user and the second user authentication information stored in the second storing unit 220 to perform the second authentication. The second control unit 270 may control the second communicating unit 260 to transmit a result of the second authentication to the first communication unit 160 of first image forming apparatus 100 through the network N.19

FIG. 4 illustrates an example of second user authentication information stored in a second image forming apparatus of the image forming system in FIG. 1. Hereinafter, a process of the second authentication will be described in detail by referring to FIG. 4. A format of the second user authentication information may correspond to that of the first user authentication information. However, it is unnecessary that the formats correspond to each other as long as the information is comparable.

The second control unit 270 may compare the user identification information transmitted from the first image forming apparatus 100 through the second communicating unit 260 with the second user authentication information.

For example, if the user identification information and the password thereof associated with 'Tom' fails in the first authentication, and is then transmitted from the first image forming apparatus 100 to the second image forming apparatus 200, the second control unit 270 may compare the second user authentication information in FIG. 4 and the received information. Since there is information corresponding to the received user identification information ('Tom') in the second user authentication information in FIG. 4, and the 'other apparatus using authority' is indicated as having been given to the user ('Tom') according to the second user authentication information ('Y' in FIG. 4), the second authentication is determined to be successful.

Also, for example, if the user identification information ('David') and the job information ('copying') which failed in the first authentication are transmitted from the first image forming apparatus 100 to the second image forming apparatus 200, the second control unit 270 may compare the second user authentication information and the transmitted information. Since 'David' is indicated as having the 'other apparatus using authority' in the second user authentication information illustrated in FIG. 4, and the 'copying' operation is indicated as being allowed to the user 'David', the second control unit 270 can determine that the authentication is successful.

Also, for example, if the user identification information associated with 'Clark' fails in the first authentication, since the corresponding user ('Clark') has no 'other apparatus using authority' ('N' in FIG. 4) although there is the user identification information ('Clark') in the second user authentication information, the second control unit 270 can determine that the second authentication fails.

The 'other apparatus using authority' information may be omitted in the first and second user authentication information. This may indicate that all users have the 'other apparatus using authority'. Accordingly, the second control unit 270 of the second image forming apparatus 200 may determine that the second authentication is successful if the user identification information received from the first image forming apparatus 100 and the user ID and the password of the second user authentication information correspond to each other.

After the determining of the second authentication is completed, the second control unit 270 may transmit the result thereof to the first image forming apparatus 100 through the second communicating unit 260.

Alternatively, the second control unit 270 may transmit the result to the first image forming apparatus 100 only if the second authentication is determined to be successful, and may not transmit the result if the second authentication is determined to fail. As another alternative, the second control unit 270 may transmit the result to the first image forming apparatus 100 only if the second authentication is determined to fail.

The first control unit 170 of the first image forming apparatus 100 may determine whether to authenticate the user depending on the result of the second authentication transmitted from the second image forming apparatus 200.

More particularly, in a case in which the second image forming apparatus 200 transmits the result regardless of the success or failure of the second authentication, the first control unit 170 determines whether to authenticate the user who wants to use the first image forming apparatus 100 based on the received result.

If information which indicates that the second authentication is successful is received from the second image forming apparatus 200, the first control unit 170 determines that the user which failed in the first authentication is successful, and therefore authenticates the user. In the case in which there are a plurality of second image forming apparatuses 200*a*, 200*b*, . . . , 200*n*, if at least one of the plurality of second image forming apparatuses 200*a*, 200*b*, . . . , 200*n* transmits a successful second authentication result, the first control unit 170 may determine that the user is successful, and accordingly authenticates the user.

If the authentication is successful, the first control unit 170 may control the job performing unit 130 to perform a predetermined job which the user requests.

Accordingly, if the user failing in the first authentication is successful in an authentication from another image forming apparatus connected to the network N, the user may be deemed authorized to use the corresponding image forming apparatus in which the user initially failed in the authentication. Accordingly, the convenience of the user can be improved.

In general, since a plurality of image forming apparatuses are disposed in different locations, if a user is restricted to using only a specific image forming apparatus in which identification information of that user is stored, it is inconvenient to the user to have to move to the corresponding image forming apparatus.

However, in the present general inventive concept, if identification information of a user is stored in one of a plurality of image forming apparatuses connected through a network, the user is capable of using any of the apparatuses by receiving an authentication from the apparatus in which the identification information of the user is stored, thereby improving the convenience of the user.

If all received results indicate that all of the second authentications have failed, the first control unit 170 may determine that the user trying to use the first image forming apparatus 100 finally fails in the authentication.

The first image forming apparatus 100 may also include an input unit 110. The input unit 110 may include a display panel 112 to operation option/results and other information, and an input key 114 to be used by a user to enter information such as the identification information discussed above. For example, a user may input an ID (name) and a password through the input key 114, and the entries may be simultaneously displayed on the display panel 112. Similar features may also be provided to an input unit 210 of the second image forming apparatus 200.

Although FIG. 2 illustrates the input unit 110 as including the display panel 112 and the input key 114, it is possible that the display panel 112 and/or the input key 114 can be disposed outside the image forming apparatus 100, and can be connected to the input unit 110 and/or the first control unit 170 through a wired or wireless connection.

If the authentication is finally determined to fail, the first control unit 170 may display that the authentication fails through the display panel 112 of the input unit 110. That the authentication fails may also be indicated to the user by an audio signal through a speaker, an e-mail, etc., in addition to the visual information displayed on the display panel 112.

The first image forming apparatus 100 and the second image forming apparatus 200 are capable of storing and updating different user authentication information.

The input units 110 and 210 may further include an external input device (not shown) to obtain the identification information of a user such as a fingerprint identification device capable of identifying a fingerprint of the user, a card reader to read information stored in a card such as an admission card and an employee card, etc. The external input device may be attached to the first and second image forming apparatuses 100 and 200, or connected thereto through a wired or wireless connection.

Here, the user identification information may be received through the first and second communicating units 160 and 260 in addition to the input units 110 and 210. For example, if the client 300 is connected on the network N, a user ID and a password may be input through the client 300. The input user ID and the password may be supplied to the first image forming apparatus 100 and/or the second image forming apparatus 200 through the network N. Also, for example, inherent information of the client 300 itself, such as an internet protocol (IP) address, a computer name and a media access control (MAC) address of the client 300, may be supplied to the first image forming apparatus 100 and/or the second image forming apparatus 200 through the network N as the user identification information.

If the client 300 sends a printing command to the first image forming apparatus 100 and/or the second image forming apparatus 200, the user ID and the password input through the client 300 or the inherent information of the client 300 itself may be supplied to the first image forming apparatus 100 and/or the second image forming apparatus 200 as the user identification information together with printing data regarding the job to be printed.

If a first user authentication information generating operation is performed, the first control unit 170 may store input information input through the input unit 110 in the first storing unit 120 as the first user authentication information. Also, if a first user authentication information updating operation is performed, the first control unit 170 may update the first user authentication information stored in the first storing unit 120 depending on input information input through the input unit 110. Accordingly, an administrator of the image forming system 1 may administrate a user authentication job by generating and updating the first user authentication information.

Also, if a second user authentication information generating operation is performed, the second control unit 270 may also store user identification (a user ID and a password, for example) input through the input unit 210 to the second storing unit 220 as the second user authentication information. Also, if a second user authentication information updating operation is performed, the second control unit 270 may also update the second user authentication information depending on input information input through the input unit 210.

As previously discussed, the first user authentication information or the second user authentication information may be received through the first communicating unit 160 or the second communicating unit 260 from the client 300 instead of being input through the input units 110 and 210.

As described above, since the user authentication information is separately stored and managed in each of the first image forming apparatus 100 and the second image forming apparatus 200, security can be increased in comparison to a case in which all user authentication information is stored in a single server.

The second image forming apparatus 200 may include a job performing unit 230. The job performing unit 230 may include a printing unit 231 to print images onto a printing medium, a scanning unit 233 to scan an image formed on a document, a facsimile unit 235, etc., or any combination thereof.

The printing unit 231 may print printing data received from the client 300 connected to the network N, printing data stored in the second storing unit 220, printing data received from some other source such as a portable memory device (not shown) or received from the image forming apparatus 100, image data of a document scanned by the scanning unit 233, etc., on the printing medium.

The printing unit 231 may employ an inkjet type printer an electrophotographic type printer, a thermal transferring type printer, etc., or any combination thereof.

The scanning unit 233 may include a charge coupled device (CCD) sensor, a contact image sensor (CIS), etc., or any combination thereof.

As described above, the second authentication request may be transmitted to all of the second image forming apparatuses 200 connected on the network N. However, sub user information may also be referred to in order to reduce the number of the second image forming apparatuses 200 to which the second authentication request must be transmitted.

FIG. 5 illustrates an example of sub user authentication information stored in the first image forming apparatus of the image forming system in FIG. 1. The sub user authentication information may be stored in the first storing unit 120 of the first image forming apparatus 100 together with the first user authentication information.

As illustrated in FIG. 5, the sub user authentication information may include position information regarding in which image forming apparatus on the network N the authentication information capable of authenticating a corresponding user are stored.

The position information may include, for example, an IP address ('123.13.1.5') of the image forming apparatus.

If the position information corresponding to the input user identification information is included in the sub user authentication information, the first control unit 170 of the first image forming apparatus 100 may transmit the second authentication request only to a second image forming apparatus 200 corresponding to the position information. Accordingly, the amount of time needed to perform the final authentication can be reduced.

If there is no position information corresponding to the input user identification information in the sub user authentication information, the second authentication request may be transmitted to all second image forming apparatuses 200 connected on the network N, as previously discussed.

Also, the sub user authentication information may be stored in each image forming apparatus, or may be stored in only a single image forming apparatus as desired.

For example, if the sub user authentication information is stored in only one image forming apparatus 200*a* of the second image forming apparatuses 200*a*, 200*b*,..., 200*n*, the other image forming apparatuses 100 and 200*b*,..., 200*n* may transmit a request of the second authentication to the second image forming apparatus 200*a* at first to perform the second authentication, and then may transmit the second authentication request to a specific image forming apparatus in which the authentication information corresponding to the user is stored according to the sub user authentication information stored in the one image forming apparatus 200*a*. Then, a result of the requested second authentication is transmitted from the image forming apparatus in which the user authentication information is stored to the image forming apparatus which transmitted the request. That is, the second authentication may be performed via the image forming apparatus storing the user authentication information.

Also, the sub user authentication information may be manually input through the input units 110 and 210 of the image forming apparatuses 100 and 200, or may be automatically generated and updated.

Although there may be no sub user authentication information at an initial time, the first image forming apparatus 100 may transmit the second authentication request to all of the second image forming apparatuses 200 on the network N, and then, based on a result of the second authentication, information regarding the second image forming apparatus 200 which transmits the result and the user identification information may be stored in the first storing unit 120 as the sub user authentication information. In this manner, the sub user authentication information can be generated along with a general second authentication operation.

As the result of the second authentication, information regarding the second image forming apparatus 200 which transmits the authentication success may be stored as the sub user authentication information together with the user identification information. In other words, the position information of the second image forming apparatus 200 which transmits the results of a successful second authentication is stored in the storing unit of the image forming apparatus which requested the second authentication.

The second image forming apparatus 200 may transmit the second authentication result as one of two alternative messages such as 'authentication success' and 'authentication failure'. Also, the 'authentication failure' may be subdivided into two more detailed messages such as 'authentication failure because there is no user authentication information' and 'authentication failure although there is a user authentication'. Such messages may be embodied by allotting two or more bits (required to indicate three values of 0, 1 and 2) in order to indicate a data field representing whether the second authentication was successful in a data packet transmitted from the second image forming apparatus 200 to the first image forming apparatus 100 as the authentication result. For example, if '0' is defined as 'authentication failure because there is no user authentication information', '1' is defined as 'authentication failure although there is a user authentication', and '2' is defined as the 'authentication success', then if the data field is '1' or '2' the IP address of the second image forming apparatus 200 and the user identification information requesting the authentication may be stored as the sub user authentication information.

In other words, position information regarding the second image forming apparatus 200 transmitting the message 'authentication failure although there is a user authentication' or the message 'authentication success' may be stored together with the user identification information as the sub user authentication information in the first storing unit 120 of the first image forming apparatus 100.

If the first image forming apparatus 100 is not used by a user for a predetermined time, the first image forming apparatus 100 may transmit a second authentication request corresponding to all second image forming apparatuses 200 connected on the network N to obtain information from the sub user authentication information which may be stored in the second image forming apparatuses 200, and may automatically update the sub user authentication information stored in the first storing unit 120 of the first image forming apparatus 100 based on a result thereof.

The sub user authentication information may be manually updated through the input unit 110 of the first image forming apparatus 100.

Also, as described above, the sub user authentication information is described to be stored in the first image forming apparatus 100, but many alternative methods of storing the sub user authentication information may be employed.

For example, identification information of a user and the position information (an IP address, etc.) of an image forming apparatus storing authentication information of the corresponding user may be concurrently recorded in an ID card such as an employee card, an identification card, an admission card, etc., which the user possesses.

Also, if information recorded in the ID card is input through the external input device (such as a card reader) of the input unit 110 of the first image forming apparatus 100, the first image forming apparatus 100 may request the authentication to an image forming apparatus corresponding to the position information.

If the first image forming apparatus 100 itself is included in the position information of the image forming apparatus corresponding to the position information, the first image forming apparatus 100 may simply perform the first authentication itself.

Here, if there is only the first image forming apparatus 100 in the position information of the image forming apparatus, only the first authentication operation in the first image forming apparatus 100 itself may be performed, and the authentication process may be ended without any second authentication performed by the second image forming apparatus 200. Then, the result of the first authentication may be regarded as the final result of the authentication.

Also, if the first image forming apparatus 100 and the second image forming apparatus 200 are together included in the position information of the image forming apparatus recorded in the ID card, at first, the first image forming apparatus 100 itself may perform the first authentication based on the identification information recorded in the ID card. Then, if the result of the first authentication is determined to fail, the second authentication may be requested of the second image forming apparatus 200 corresponding to the remaining position information.

As described above, the position information of the image forming apparatus is described to be recorded in the ID card, but the position information may be directly input through the input unit 110 from a user as desired.

Figure 6:
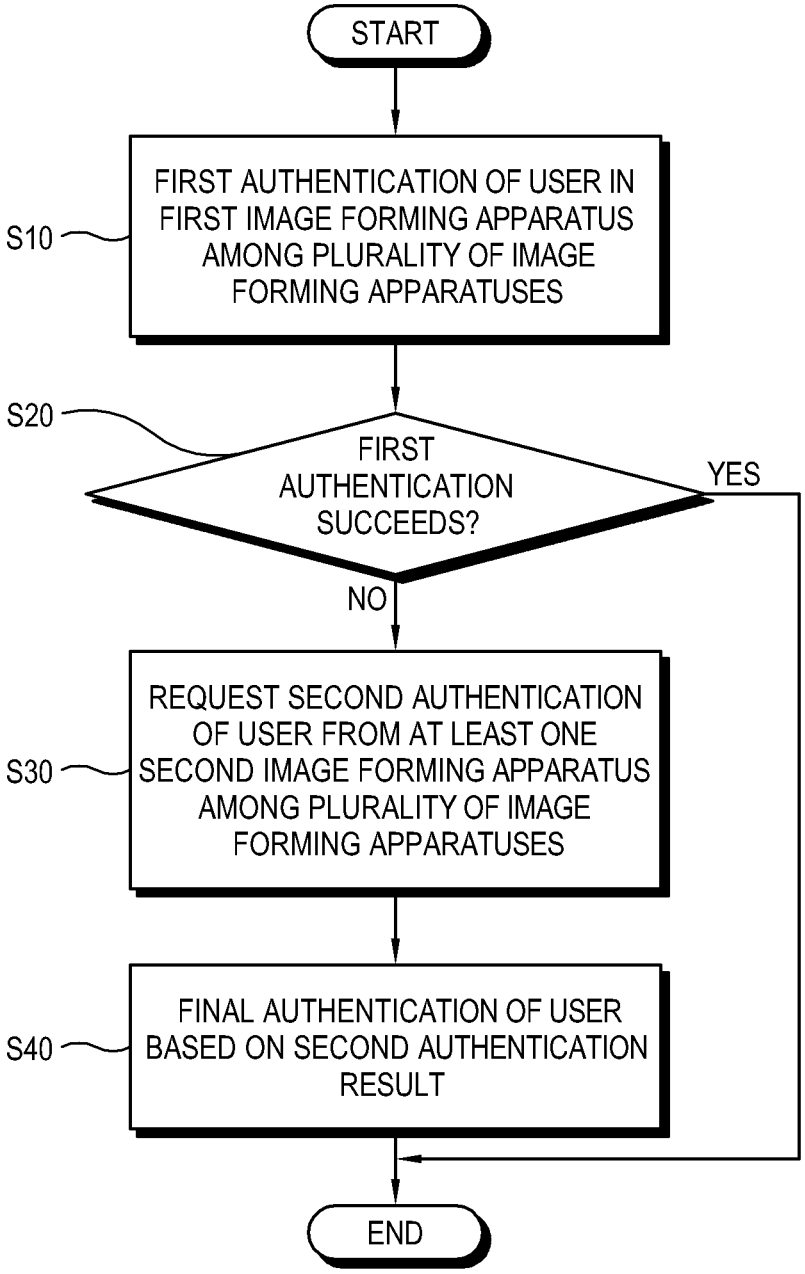
FIG. 6 is a flowchart illustrating a user authenticating method of an image forming system according to an exemplary embodiment of the present general inventive concept.

FIG. 6 is a flowchart illustrating a user authenticating method of an image forming system according to an exemplary embodiment of the present general inventive concept. This user authenticating method of the image forming system 1 will be described by referring to FIGS. 1-6.

The image forming system 1 may include a plurality of image forming apparatuses 100 and 200 connected through the network N to communicate with each other. Here, the plurality of image forming apparatuses 100 and 200 may be respectively implemented as a printer, a scanner, a facsimile, a multifunction device, etc.

At operation S10, a first authentication of a user is performed in the first image forming apparatus 100. As described above, the authentication is possible by comparing and determining whether first user authentication information stored in the first storing unit 120 corresponds to identification information of the user.

The identification information of the user may include at least one of an internet protocol (IP) address, a computer name, a media access control (MAC) address of the client 300 in FIG. 1, etc. In other words, identification information of a computer used by the user may be used in addition to, or instead of, typical identification information such as a user ID and a password. Also, the user identification information may include fingerprint information of the user input through an external input device such as a fingerprint identification device, information recorded in an identification card and/or an employee card of the user input through an external input device such as a card reader, etc., or any combination thereof, in addition to the other identification methods described above. The user identification information may take various forms, as long as the user identification information can identify the user.

The first user authentication information may be provided in a type comparable with the user identification information. For example, if a user ID and a password are input through the input unit 110 of the first image forming apparatus 100 as the user identification information, as illustrated in FIG. 3, the first user authentication information may include information about the user ID and the password assigned to each user to be comparable with the input user identification information.

After performing the first authentication at operation S10, at operation S20 it is determined whether the first authentication is successful. If the first authentication is successful, the user is authenticated and the method ends. If the first authentication fails, at operation S30 a second authentication of the user is requested from at least one second image forming apparatus 200.

The second authentication of the user may be requested from all of the second image forming apparatuses 200 connected to the network N.

As described above, if there is position information is stored in the first image forming apparatus 100 regarding the second image forming apparatus 200 in which the authentication information of the user is stored, the second authentication may be requested from only the second image forming apparatus 200 corresponding to the stored position information.

For example, if a user 'Tom' enters user identification information in an attempt to use the first image forming apparatus 100, after the first authentication fails, as illustrated in FIG. 5, the second authentication of 'Tom' may be requested from only the second image forming apparatus 200 having the IP address of '124.13.1.5', which is the second image forming apparatus which stores the user authentication information regarding 'Tom'. As previously described, such position information may be included in the sub user authentication information stored in the first storing unit 120 of the image forming apparatus 100.

If the sub user authentication information including the position information of the image forming apparatus storing the authentication information of the user necessary to the authentication of the user is stored in a specific image forming apparatus, as described above, the second authentication may be performed via that specific image forming apparatus.

For example, if the first image forming apparatus 100 transmits the second authentication request to a specific image forming apparatus, the specific image forming apparatus may use the sub user authentication information stored therein to request the second authentication from the corresponding image forming apparatus storing the authentication information of the user instead of the first image forming apparatus 100. Then, the specific image forming apparatus may receive a result of the requested second authentication to transmit to the first image forming apparatus 100. Also, the result of the second authentication may be transmitted directly to the first image forming apparatus 100 without being transmitted via the specific image forming apparatus.

In operation S40, the first image forming apparatus 100 finally authenticates the user based on the second authentication result of the second image forming apparatus 200.

Accordingly, if a user is registered with one image forming apparatus of the image forming system 1, the user may be capable of using the other image forming apparatuses without registering with the other image forming apparatuses, thereby improving a user convenience.

Also, the user authentication information can be dispersed and stored in a plurality of image forming apparatuses of the image forming system 1, thereby improving security.

Figure 7:
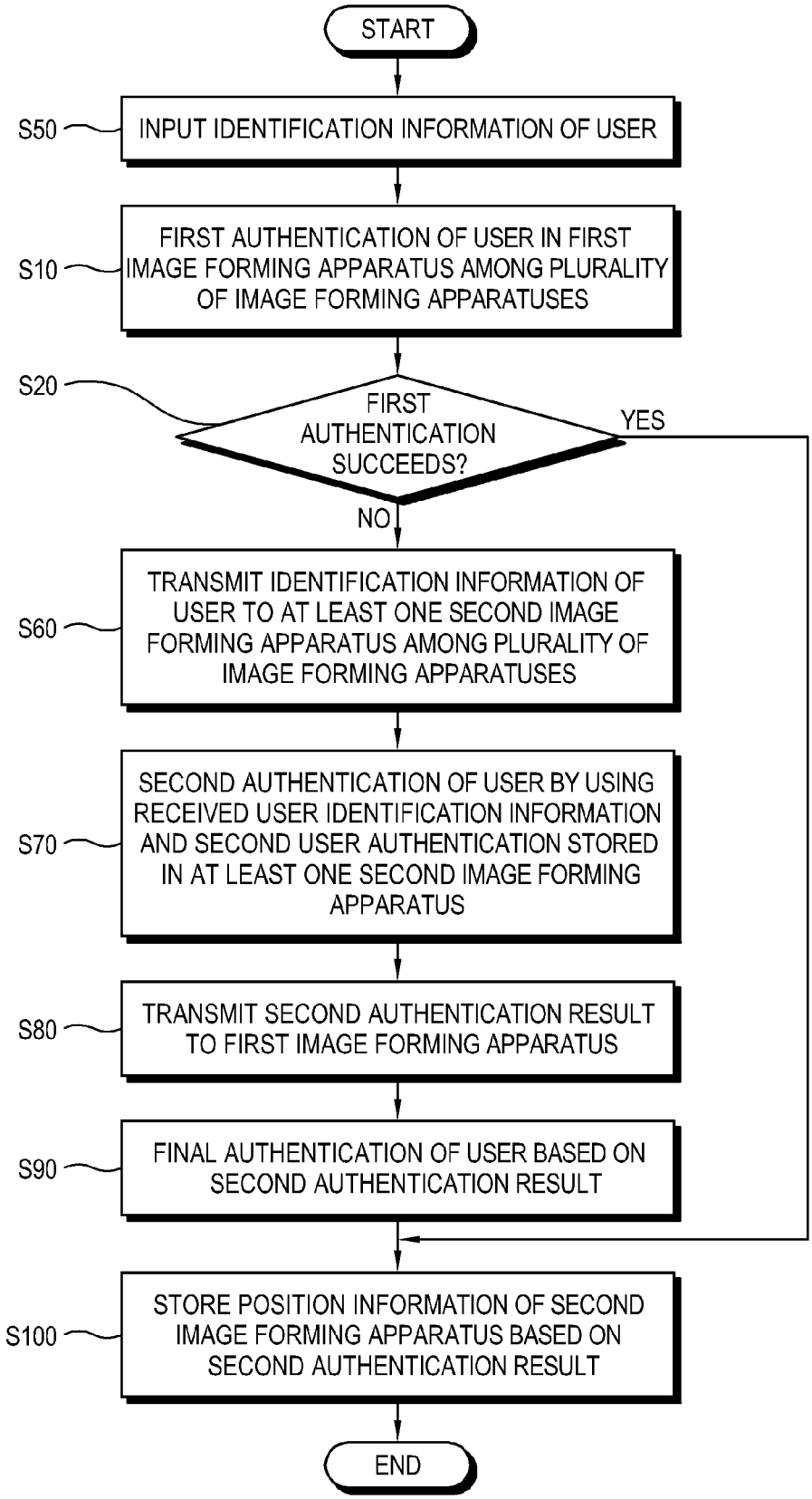
FIG. 7 is a flowchart illustrating a user authenticating method of an image forming system according to another exemplary embodiment of the present general inventive concept.

FIG. 7 is a flowchart illustrating a user authenticating method of an image forming system according to another exemplary embodiment of the present general inventive concept. This user authenticating method of the image forming system 1 will be described by referring to FIGS. 1-5 and 7.

At operation S50, identification information of a user is input.

If the user wants to use the first image forming apparatus 100 in the image forming system 1, the user identification information may be input through the input unit 110 of the first image forming apparatus 100. The user identification information may be a user ID and a password entered by the user by pressing the input key 114 of the input unit 110. Alternatively, as described above, the user identification information may be information input through an external input device such as a fingerprint identification apparatus, a card reader, etc.

At operation S10, which is the same operation described in FIG. 6, a first authentication of the user may be performed in the first image forming apparatus 100 receiving the user identification information.

The first authentication may be determined based on whether first user authentication information stored in the first image forming apparatus 100 corresponds to the user identification information.

Job information about a job requested by the user may be further input in addition to the user identification information in the first authentication. As described above, if predetermined job performing authority information (allowance or not of scanning, copying, printing, facsimile, color printing/mono printing, etc.) is included in the first user authentication information, the success or failure of the authentication may depend on the kind of the job which the user requests.

After the first authentication is performed in operation S10, it is determined whether the first authentication of the user is successful as operation S20. If the first authentication fails ('NO' at operation S20), at operation S60 the input user identification information is transmitted to at least one second image forming apparatus 200.

The job information may be transmitted to the second image forming apparatus 200 together with the user identification information.

At operation S70, the second image forming apparatus 200 may perform a second authentication by using second user authentication information stored in the second image forming apparatus 200 and the received user identification information.

Here, the second authentication may be performed by comparing the received user identification information and the second user authentication information and determining whether they correspond. If the user identification information does correspond to the second user authentication information stored in the second image forming apparatus 200, the authentication may be determined to succeed. If the user identification information does not correspond to the second user authentication information stored in the second image forming apparatus 200, the authentication may be determined to fail.

As illustrated in FIG. 4, the second user authentication information may include comparison information comparable with the received user identification information. Also, the second user authentication information may further include 'other apparatus using authority' information indicating whether the corresponding user has an authority to use other image forming apparatuses besides the image forming apparatus in which the second user authentication information is stored.

If the 'other apparatus using authority' information is included in the second user authentication information, although the received user identification information corresponds with the second user authentication information, the result of the second authentication may be determined to fail if there is no 'other apparatus using authority' assigned to the user. Conversely, if the received user identification information corresponds to the second user authentication information, and the user has the 'other apparatus using authority', the result of the second authentication can be determined to succeed.

Accordingly, the 'other apparatus using authority' can be differently assigned to each user, thereby easily indicated whether a certain image forming apparatus may respond to a job request of a user.

After the second authentication is completed, in operation S80 the second image forming apparatus 200 may transmit the second authentication result to the first image forming apparatus 100.

The transmission of the second authentication results in operation S80 may be conducted in different ways. For example, the result may be transmitted to the first image forming apparatus 100 only if the authentication is determined to succeed. Conversely, the result may be transmitted only if the authentication is determined to fail. Also, the result may be transmitted to the first image forming apparatus regardless of the result.

In operation S90, the first image forming apparatus 100 finally authenticates the user based on the second authentication result.

In a case in which the second image forming apparatus 200 always transmits the second authentication result to the first image forming apparatus 100 irrespective of the success or failure, the first image forming apparatus 100 may determine that the user finally succeeds in the authentication if the transmitted second authentication result indicates success.

Also, if the second authentication result indicating success is not received during a predetermined time, the first image forming apparatus 100 may determine that the user authentication finally fails.

In a case in which the second image forming apparatus 200 transmits the result only in case of 'authentication success' after the second authentication is completed, if the second authentication result is not transmitted from the second image forming apparatus 200 during a predetermined time, it may be determined that the authentication of the user finally fails.

Conversely, if the second image forming apparatus 200 transmits the result only in case of 'authentication failure' after the second authentication is completed, if the second authentication result is not transmitted from the second image forming apparatus 200 during a predetermined time, it can be determined that the authentication of the user finally succeeds.

In operation S100, the first image forming apparatus 100 may store position information of the second image forming apparatus storing the authentication information of the user based on the second authentication result.

Here, the position information of the second image forming apparatus may be stored in the sub user authentication information stored in the first storing unit 120.

Accordingly, if a user fails in the first authentication, and succeeds in the second authentication, and later wants to use the first image forming apparatus 100 again, since it is sufficient to request the second authentication from only the second image forming apparatus 200 if the second authentication succeeded, rather than any others of the plurality of second image forming apparatuses 200, the authentication time can be reduced.

If the final authentication result is stored in the first image forming apparatus 100 and the same user contacts again, using of the first image forming apparatus 100 may be allowed or disallowed depending on success or failure of the final authentication result.

Figure 8:
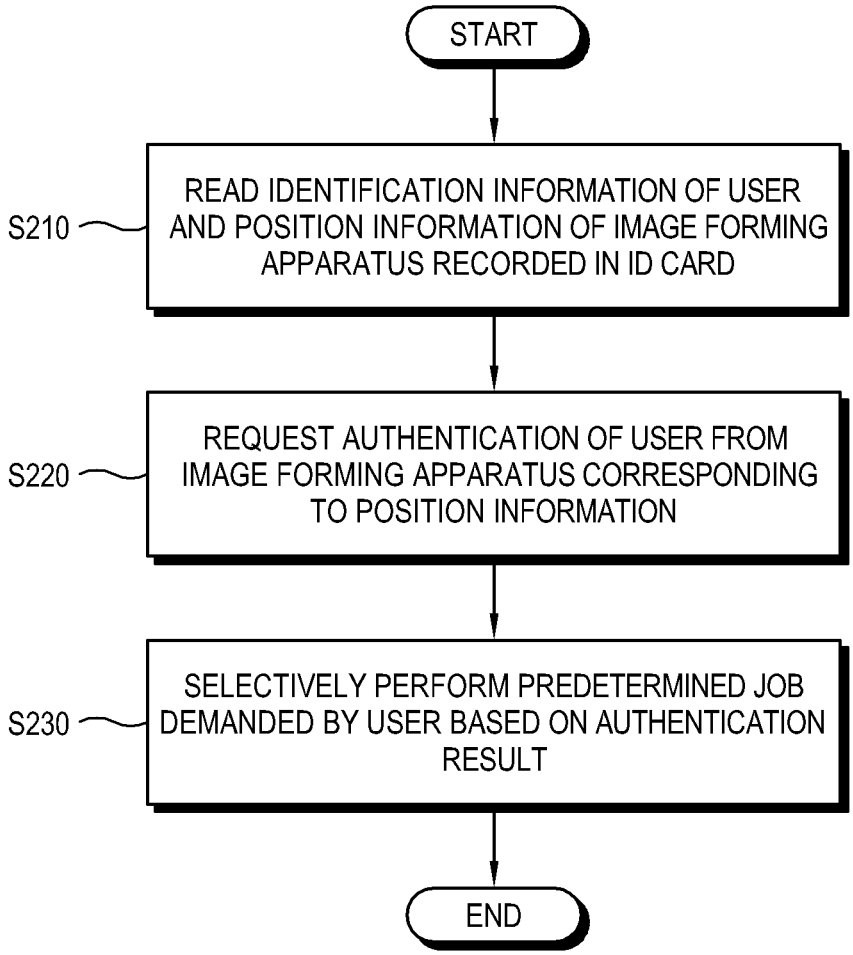
FIG. 8 is a flowchart illustrating a control method of an image forming system according to an exemplary embodiment of the present general inventive concept.

FIG. 8 is a flowchart illustrating a control method of an image forming system according to an exemplary embodiment of the present general inventive concept. Hereinafter, a control method of the image forming system 1 according to this exemplary embodiment will be described by referring to FIGS. 1-5 and 8.

In operation S210, information recorded in an ID card of a user wanting to use the first image forming apparatus 100 is read through a card reader (not shown) of the input unit 110 of the first image forming apparatus 100.

In the ID card, identification information of the user and position information of an image forming apparatus storing authentication information necessary to authenticate the user may be recorded together.

In operation S220, an authentication of the user is requested from any of the image forming apparatuses 100 and 200 existing in the image forming system 1 corresponding to the position information recorded in the ID card.

In operation S230, a predetermined job which the user requests is selectively performed based on the authentication result. That is, the predetermined job may be performed if the authentication result indicates success. Also, if the authentication result indicates failure, the predetermined job may be cancelled, and the user may be informed of the cancellation of the job.

The predetermined job may include copying, printing (color/mono), scanning, facsimile, etc., or any combination thereof, as described above.

Accordingly, a separate authentication server is not necessary in the process of authenticating a user.

Also, since the position information of an image forming apparatus storing the user authentication information is stored together in the ID card of the user, and by using this, the authentication is directly requested to the specific image forming apparatus, the authentication time can be further reduced. For example, if there are a plurality of image forming apparatuses in the image forming system 1, by requesting the second authentication from only the one of the plurality of image forming apparatuses that corresponds to the position information, the authentication time can be reduced because the request does not have to be transmitted to, nor the results received from, the remaining image forming apparatuses in the image forming system 1.

Figure 9:
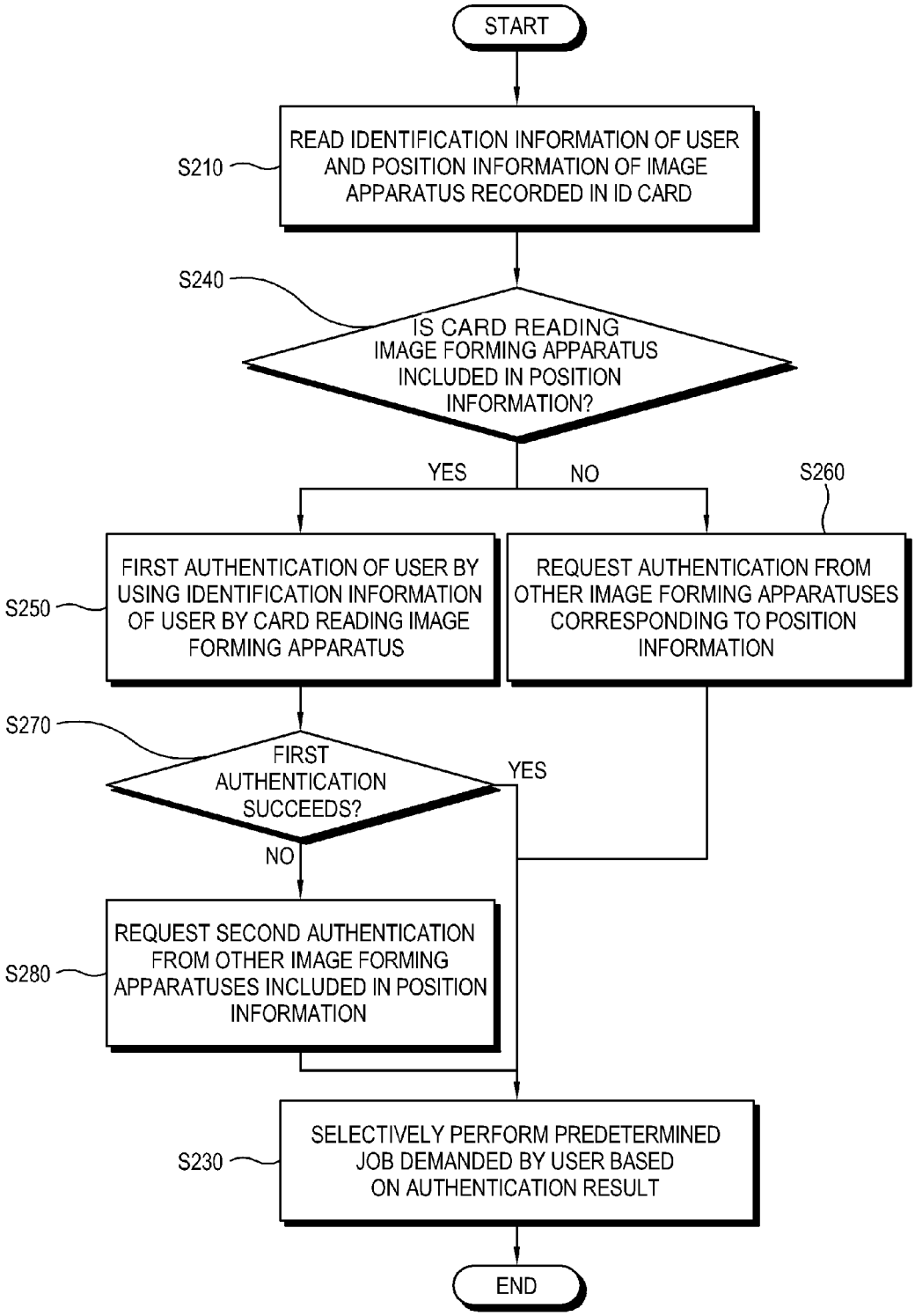
FIG. 9 is a flowchart illustrating a control method of an image forming system according to another exemplary embodiment of the present general inventive concept.

FIG. 9 is a flowchart illustrating a control method of an image forming system according to another exemplary embodiment of the present general inventive concept. Hereinafter, a control method of the image forming system 1 according to this exemplary embodiment will be described by referring to FIGS. 1-5 and 9.

As illustrated in FIG. 9, this exemplary embodiment illustrates an alternative to the operation S220 of the exemplary embodiment illustrated in FIG. 8. Operations S210 and S230 may be the same as those illustrated in FIG. 8.

After identification information of a user and position information of an image forming apparatus storing the authentication information of the user recorded in an ID card of the user are read in operation S210, it is determined whether image forming apparatus at which the ID card is read is included in the position information in operation S240.

If the first image forming apparatus 100 at which the ID card is read is included in the position information ('YES' in operation S240), at operation S250 the first image forming apparatus 100 performs a first authentication of the user by using the identification information of the user and first user authentication information stored in the first storing unit 120 of the first image forming apparatus 100.

At operation S270, it is determined whether the first authentication succeeds. If the first authentication succeeds, the method proceeds to operation S230. If the first authentication does not succeed, in operation S280 a second authentication is requested from other image forming apparatuses (for example, the second image forming apparatus 200) included in the position information.

If the image forming apparatus 100 at which the ID card is read is not included in the position information ('NO' in operation S240), in operation S260 the authentication is requested from an image forming apparatus (for example, the second image forming apparatus 200) included in the position information.

A predetermined job which the user requests may be performed in operation S230 according to the first authentication result of operation S250, the requested second authentication result of operation S280, or the authentication result of operation S260.

That is, if the first authentication result is determined to successful, the final authentication result may be determined to be successful. Also, the success or failure of the final authentication may be determined according to the second authentication result in operation S280. Also, the success or failure of the authentication of the user may be determined according to the authentication result requested from the other image forming apparatuses.

Figure 10:
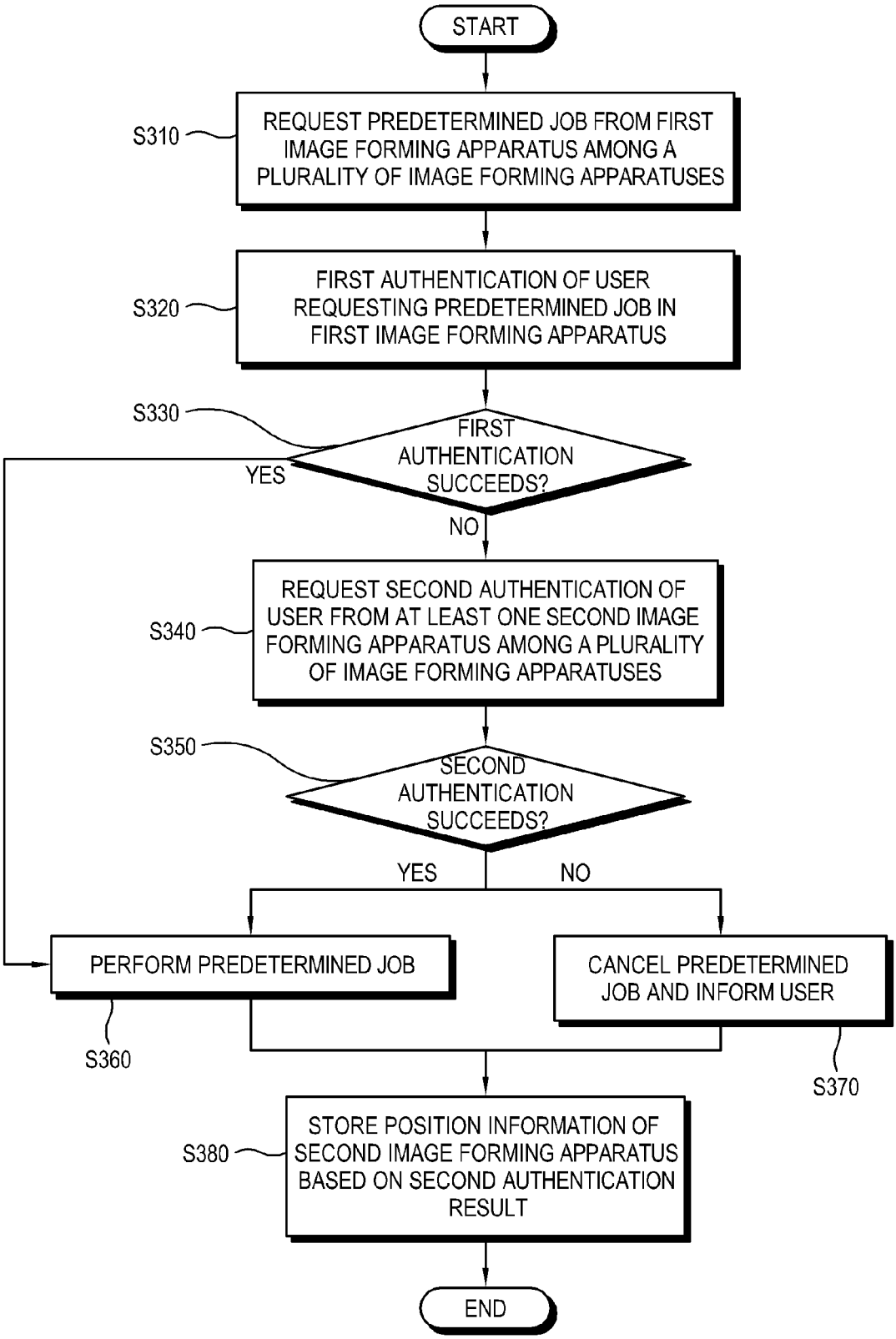
FIG. 10 is a flowchart illustrating a control method of an image forming system according to yet another exemplary embodiment of the present general inventive concept.

In the exemplary embodiments discussed in regard to FIGS. 9 and 10, the position information of the image forming apparatus is exemplarily described to be received from the ID card, but such position information may be manually input through the input units 110 and 210 of the image forming apparatuses 100 and 200 by the user as necessary.

FIG. 10 is a flowchart illustrating a control method of an image forming system according to yet another exemplary embodiment of the present general inventive concept. Hereinafter, a control method of the image forming system 1 according to this exemplary embodiment will be described by referring to FIGS. 1-5 and 10. The control method of this embodiment may employ the user authenticating method described in the discussion of the embodiments illustrated in FIGS. 8 and 9.

In operation S310, a predetermined job is requested from the first image forming apparatus 100 among a plurality of image forming apparatuses 100 and 200 of the image forming system 1.

Here, the predetermined job may include scanning, copying, printing (color/mono), facsimile, etc., or any combination thereof.

In operation S320, the first image forming apparatus 100 performs a first authentication of the user requesting the predetermined job. The first authentication method may be performed as described above.

In operations S330, it is determined whether the first authentication is successful. If the first authentication fails, in operation S340 a second authentication of the user may be requested from at least one second image forming apparatuses 200.

In operation S350, it is determined whether the second authentication succeeds. In operation S360, if the second authentication is successful, the predetermined job may be performed by the first image forming apparatus 100.

In operation S380, the first image forming apparatus 100 may store position information of the second image forming apparatus 200 which stores the authentication information of the user based on the second authentication result.

The position information of the second image forming apparatus 200 may include an IP address of the second image forming apparatus 200 which performed the successful second authentication.

The first image forming apparatus 100 may store the position information regarding the second image forming apparatus 200 and the identification information of the user corresponding thereto as sub user authentication information inside the first storing unit 120 of first image forming apparatus 100.

Accordingly, if the user which was successful in the second authentication attempts to use the first image forming apparatus 100 again, the second authentication may be requested from only the second image forming apparatus 200 which performed the successful second authentication by using the stored sub user authentication information. Accordingly, the authentication time necessary to perform the final authentication can be further reduced.

Also, if the second authentication fails (NO' in operation S350), the authentication failure may be informed to the user in operation S370. The predetermined job requested by the user may be cancelled while the authentication failure is informed.

If the first authentication succeeds ('YES' in operation S330 or S350), the predetermined job may be performed in operation S360.

Accordingly, although the authentication in the first image forming apparatus 100 may fail, if the authentication in the second image forming apparatus 200 succeeds, the first image forming apparatus 100 may be capable of being used, thereby improving a user convenience.

As described above, an image forming system, a user authenticating method thereof and a control method thereof according to the present general inventive concept have at least the following features and/or advantages.

First, since it is possible to authenticate a user without a separate authentication server, an image forming system can be configured with a low cost.

Second, since user authentication information may be stored in more than one image forming apparatus, security can be increased.

Third, since a user whose authentication information does not exist in a first image forming apparatus of the image forming system may be capable of using the first image forming apparatus if succeeding in a user authentication through a second image forming apparatus of the image forming system, a user convenience can be improved.

Fourth, since authenticating may be directly requested from an image forming apparatus in which authentication information of a user is stored, time required in authenticating can be reduced.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A user authenticating method of an image forming system which includes a plurality of image forming apparatuses communicably connected, the method comprising:

performing a first authentication of a user in a first image forming apparatus of the plurality of image forming apparatuses;

requesting a second authentication of the user from at least one second image forming apparatus of the plurality of image forming apparatuses in response to the first authentication failing in the first image forming apparatus; and finally determining authentication of the user based on a result of the second authentication, the at least one second image forming apparatus transmitting the result of the second authentication when the second authentication is successful and not transmitting the result of the second authentication when the second authentication is not successful.

2. The method according to claim 1, further comprising:

determining that the first authentication failed in response to first authentication information stored in the first image forming apparatus not corresponding with identification information of the user.

3. The method according to claim 1, wherein, if stored position information indicates the second image forming apparatus in which authentication information of the user is stored, the requesting the second authentication comprises requesting the second authentication of the user from only the second image forming apparatus identified in the position information.

4. The method according to claim 1, wherein the requesting the second authentication of the user comprises:

performing the second authentication based on identification information of the user and second user authentication information stored in the second image forming apparatus.

5. The method according to claim 4, wherein the second user authentication information comprises other apparatus using authority information assigned to users regarding whether the corresponding user is authorized to use other image forming apparatuses besides the second image forming apparatus in which the second user authentication information is stored.

6. The method according to claim 5, further comprising:

transmitting an authentication success to the first image forming apparatus as a result of the second authentication in response to the user having the other apparatus using authority.

7. The method according to claim 5, further comprising:

transmitting an authentication success to the first image forming apparatus as a result of the second authentication in response to the user having the other apparatus using authority, and not transmitting the result of the second authentication to the first image forming apparatus in response to the user not having the other apparatus using authority.

8. The method according to claim 1, wherein the finally determining authentication of the user comprises:

determining that the authentication of the user finally fails in response to the result of the second authentication not being received from the second image forming apparatus during a predetermined time.

9. The method according to claim 1, wherein the second image forming apparatus stores authentication information of the user, the method further comprising:

storing position information of the second image forming apparatus storing the authentication information of the user based on the result of the second authentication transmitted from the second image forming apparatus.

10. A control method of an image forming system which includes a plurality of image forming apparatuses communicably connected, the method comprising: inputting through an input unit identification information of a user, the user identification information comprising a user identification (ID) and position information of an image forming apparatus in which authentication information of the user is stored in a storing unit; requesting a first authentication of the user at a first image forming apparatus; requesting a second authentication of the user from an image forming apparatus corresponding to the position information of the inputted user identification information when the first authentication fails; and selectively performing a predetermined job which the user requests based on the first and second authentication results.

11. The method according to claim 10, wherein the inputting the user identification information comprises inputting information recorded in an identification (ID) card of the user through an external input device of the input unit.

12. The method according to claim 10, wherein the user identification information is included with the position information.

13. A control method of an image forming system which includes a plurality of image forming apparatuses communicably connected, the method comprising:

requesting a job from a first image forming apparatus of the plurality of image forming apparatuses;

performing a first authentication of a user requesting the job based on first user authentication information in the first image forming apparatus;

requesting a second authentication of the user from at least one second image forming apparatus of the plurality of image forming apparatuses in response to a failure of the first authentication in the first image forming apparatus; and selectively performing the job based on a result of the second authentication, the at least one second image forming apparatus transmitting the result of the second authentication when the second authentication is successful and not transmitting the result of the second authentication when the second authentication is not successful.

14. The method according to claim 13, wherein the predetermined job comprises scanning, copying, faxing, color printing, mono printing, or any combination thereof.

15. The method according to claim 13, wherein the first user authentication information comprises:

using authority information of the job, other apparatus using authority information regarding whether the user is authorized to use the second image forming apparatus, or a combination thereof, respective to any users stored in the first user authentication information.

16. The method according to claim 13, further comprising:

storing position information of the second image forming apparatus storing an authentication information of the user based on the second authentication result.

17. The method according to claim 13, further comprising:

informing the user of an authentication failure when no second authentication result is received from at least one of other image forming apparatuses.

18. An image forming system, comprising:

a first image forming apparatus including a first communicating unit and a first storing unit to store first user authentication information; and a second image forming apparatus including a second communicating unit to communicate with the first communicating unit and a second storing unit to store second user authentication information;

wherein the first image forming apparatus performs a first authentication using user identification information and the first user authentication information, and requests a second authentication from the second image forming apparatus in response to failure of the first authentication; and the second image forming apparatus performs the second authentication using the user identification information and the second user authentication information, and transmits a result of the second authentication to the first image forming apparatus when the result of the second authentication is successful and does not transmit the result of the second authentication to the first image forming apparatus when the second authentication is not successful.

19. The image forming system according to claim 18, wherein the first image forming apparatus determines that the first authentication fails in response to there being no information stored in the first user authentication information regarding a user requesting authentication.

20. The image forming system according to claim 18, wherein the first user authentication information and/or the second user authentication information includes other apparatus using authority information indicating whether a user is authorized to use another apparatus.

21. The image forming system according to claim 20, wherein the second image forming apparatus transmits an authentication success to the first image forming apparatus as the second authentication result in response to the user having other apparatus using authority.

22. The image forming system according to claim 18, wherein the first image forming apparatus further comprises an input unit to receive the user identification information.

23. The image forming system according to claim 18, wherein the first image forming apparatus performs a job of scanning, copying, printing, faxing, or any combination thereof in response to receiving a successful second authentication result from the second image forming apparatus.

24. The image forming system according to claim 18, wherein the first image forming apparatus informs the user of the authentication failure in response to failure of the second authentication.

25. The image forming system according to claim 18, wherein, if position information stored in the first storing unit indicates the second image forming apparatus storing the authentication information of the user, the first image forming apparatus requests the second authentication of the user from only the second image forming apparatus corresponding to the position information.

26. The image forming system according to claim 18, wherein the first image forming apparatus stores position information of the second image forming apparatus storing the authentication information of the user in the first storing unit based on the second authentication result.

* * * * *